US006062313A

United States Patent [19]

Moore

[11] Patent Number: 6,062,313

[45] Date of Patent: May 16, 2000

[54] EXPANDABLE TANK FOR SEPARATING PARTICULATE MATERIAL FROM DRILLING FLUID AND STORING PRODUCTION FLUIDS, AND METHOD

[76] Inventor: Boyd B. Moore, 427 Mignon, Houston, Tex. 77024

[21] Appl. No.: 09/037,313

[22] Filed: Mar. 9, 1998

[51] Int. Cl.[7] ..... E21B 7/12

[52] U.S. Cl. ..... 166/357; 210/170

[58] Field of Search ..... 175/66, 206, 207, 175/209, 215, 217, 218; 166/357; 210/170, 797, 532.1

[56] References Cited

U.S. PATENT DOCUMENTS

| | | | |
|---|---|---|---|
| 2,357,565 | 9/1944 | Vietti et al. | 252/8.5 |
| 3,684,038 | 8/1972 | Nelson | 175/66 |
| 3,817,383 | 6/1974 | Michel et al. | 210/170 |
| 4,133,761 | 1/1979 | Posgate | 210/170 |
| 5,232,475 | 8/1993 | Jepson | 55/36 |

OTHER PUBLICATIONS

Perry et al., Perry's Chemical Engineer's Handbook, fourth ed., McGraw–Hill Book Co., pp. 23–64, 1963.

*Primary Examiner*—David Bagnell
*Assistant Examiner*—Zakiya Walker
*Attorney, Agent, or Firm*—Fulbright & Jaworski L.L.P.; Paul E. Krieger

[57] ABSTRACT

A system for separating particulate material from drilling fluid for underwater wells of the type which comprise an above-water drilling platform, a string of drill pipe extending from the platform to the subsea floor for drilling the well and an annulus extending into an earth formation beneath the subsea floor. The drill pipe runs through the annulus into the formation for drilling a well in the formation. Also included is a system for circulating a drilling fluid downwardly through the string of drill pipe and upwardly through the annulus for removing particulate material generated from drilling the well. The system further including a return conduit and pump for returning the drilling fluid to the water surface. The system comprises an expandable tank positioned on the subsea floor and connected between the annulus and the return conduit so that the drilling fluid flows through the tank. The tank is shaped and dimensioned to allow at least a substantial amount of particulate material to settle out of the drilling fluid as the fluid flows through the tank to the return conduit. The tank can also be used for separating particulate matter from drilling fluid for land wells; and as a storage tank for production wells, both subsea and on land.

37 Claims, 3 Drawing Sheets

EXPANDABLE TANK FOR SEPARATING PARTICULATE MATERIAL FROM DRILLING FLUID AND STORING PRODUCTION FLUIDS, AND METHOD

BACKGROUND OF THE INVENTION

1. Field of the Invention

This invention relates to expandable tanks and, in particular, their use for separating particulate material from drilling fluid for underwater and land wells and storing production fluids for such wells.

2. Description of the Related Art

The use of drilling fluid is an important aspect of drilling underground wells. The drilling fluid carries cuttings from the bottom of the drill hole to the surface, which are separated out so that the fluid can be recirculated back into the hole. Another important function of drilling fluid is for containing gas and oil in a pressurized formation by exerting a slight overbalance on the formation. This is done by regulating the specific gravity of the drilling fluid through the use of material having different densities.

The technology for using drilling fluids for land wells and shallow subsea wells is well developed. However, with deep water wells, in water from 2,500–10,000 feet deep, and deeper, significant problems have developed in the use of drilling fluids. When the drill bit enters shallow sand formations that are near the subsea floor, sufficient fluid weight is needed to contain gas or liquids under pressure in the sand formation. In deep water, it is difficult to maintain the proper hydrostatic head for circulating the drilling fluid because of its heavy weight and the distance from the subsea floor to the sea surface. If a sufficient weight is not maintained in the column of drilling fluid above the drill bit, a blow out can occur if a zone of gas and oil under pressure is penetrated.

On the other hand, if the weight of drilling fluid in the column above the bit exceeds the fracture pressure of a formation, drilling fluid will flow into the formation and empty the column, with no downward pressure being exerted on the formation. A blowout can then occur if a zone is entered which contains oil and gas under high pressure.

Thus, there is a problem with maintaining the proper hydrostatic head in circulating drilling fluid for deep water wells. There is also a problem with supplying a pump with a capacity great enough to return the drilling fluid to the water surface for deep water wells when the fluid contains cuttings from the drill bit, which adds significantly to the weight of the drilling fluid and compounds the problem of controlling the proper drilling fluid density for safe well control.

SUMMARY OF THE INVENTION

The problems discussed above have been solved by providing a system for separating particulate matter from drilling fluid for underwater wells of the type that include a string of drill pipe and/or an outer string of riser pipe, extending from the platform to the subsea floor for drilling the well. An annulus extends into an earth formation beneath the subsea floor. Drill pipe runs through the annulus into the formation for drilling a well in the formation. Drilling fluid is circulated downwardly through the string of drill pipe and annulus for removing particulate matter generated from drilling the well. A pump in the return conduit returns the drilling fluid to the water surface.

An expandable tank is connected between the annulus and the return conduit. The tank is positioned on the subsea floor so that the drilling fluid flows through the tank. The tank is shaped and dimensioned to allow at least a substantial amount of particulate matter to settle out of the drilling fluid as the fluid flows through the tank to the return conduit. A tank of this type provides a balanced system because the water pressure that bears on the outer surface of the bag is equalized by the fluid that flows through the tank. Most importantly, this tank prevents particulate matter and liquids from the drilling fluid, such as mud, cuttings and chemicals, from commingling or mixing with the sea water.

The tank is expandable and can be formed of a flexible material that can be rolled or folded while being transported. The tank can be formed of one or two layers in order to provide a single or double walled tank. Preferably, the tank is formed at least in part of an elastomeric material. Neoprene is a preferred elastomeric material.

There can be an inlet conduit between the annulus and the tank, which includes a control valve for selectively allowing drilling fluid to flow either into or out of the tank through the inlet. The control valve can be remotely actuated.

A gas conduit can also be connected between the inlet conduit and the return conduit. An apparatus is connected between the inlet conduit and gas conduit for separating the gas and the drilling fluid before the drilling fluid enters the tank. Preferably, the pump for circulating the drilling fluid is connected to the return conduit.

A flow path is provided in the tank that is long enough to provide a substantial resonance time to allow at least a substantial amount of the particulate material in the fluid to settle in the tank before the fluid flows into the return conduit. This flow path can include an inlet hose in the tank connected to the inlet conduit and extending across a substantial distance in the tank. An outlet is connected to the return conduit in the vicinity of the connection between the inlet hose and inlet conduit for allowing the fluid to travel a substantial distance in the tank before flowing into the return conduit.

A plurality of expandable tanks can be connected in parallel to conduits receiving mud from annuluses for a plurality of subsea wells, or a plurality of tanks can be connected in series to one or more annuluses.

The invention also includes a method for separating particulate material from drilling fluid while drilling the subsea well. The method includes the steps of connecting an expandable tank located on the subsea floor between an annulus of an underwater well and a return conduit for the drilling fluid. The tank is shaped and dimensioned to allow at least a substantial amount of the particulate material to settle out of the drilling fluid as the fluid flows through the tank. Drilling fluid is circulated downwardly through the drill pipe, extending through the annulus and upwardly through the annulus as the well is being drilled. Particulate material is separated from the drilling fluid by flowing the drilling fluid from the annulus through the tank.

The tank can be positioned on the subsea floor by lowering the tank from the surface in a rolled or folded condition, and then unrolling or unfolding the tank after it is on the subsea floor. The method includes the use of a tank described above in connection with the system.

The invention is also directed to a tank which can be used in the system and method described above. The tank is used to separate particulate matter from drilling fluid as the drilling fluid flows through the tank from the well annulus to the return conduit.

BRIEF DESCRIPTION OF THE DRAWINGS

The invention can be better understood by referring to the detailed description of an exemplary embodiment set forth below, considered in conjunction with the following drawings, in which.

DETAILED DESCRIPTION OF INVENTION

Figure 1:
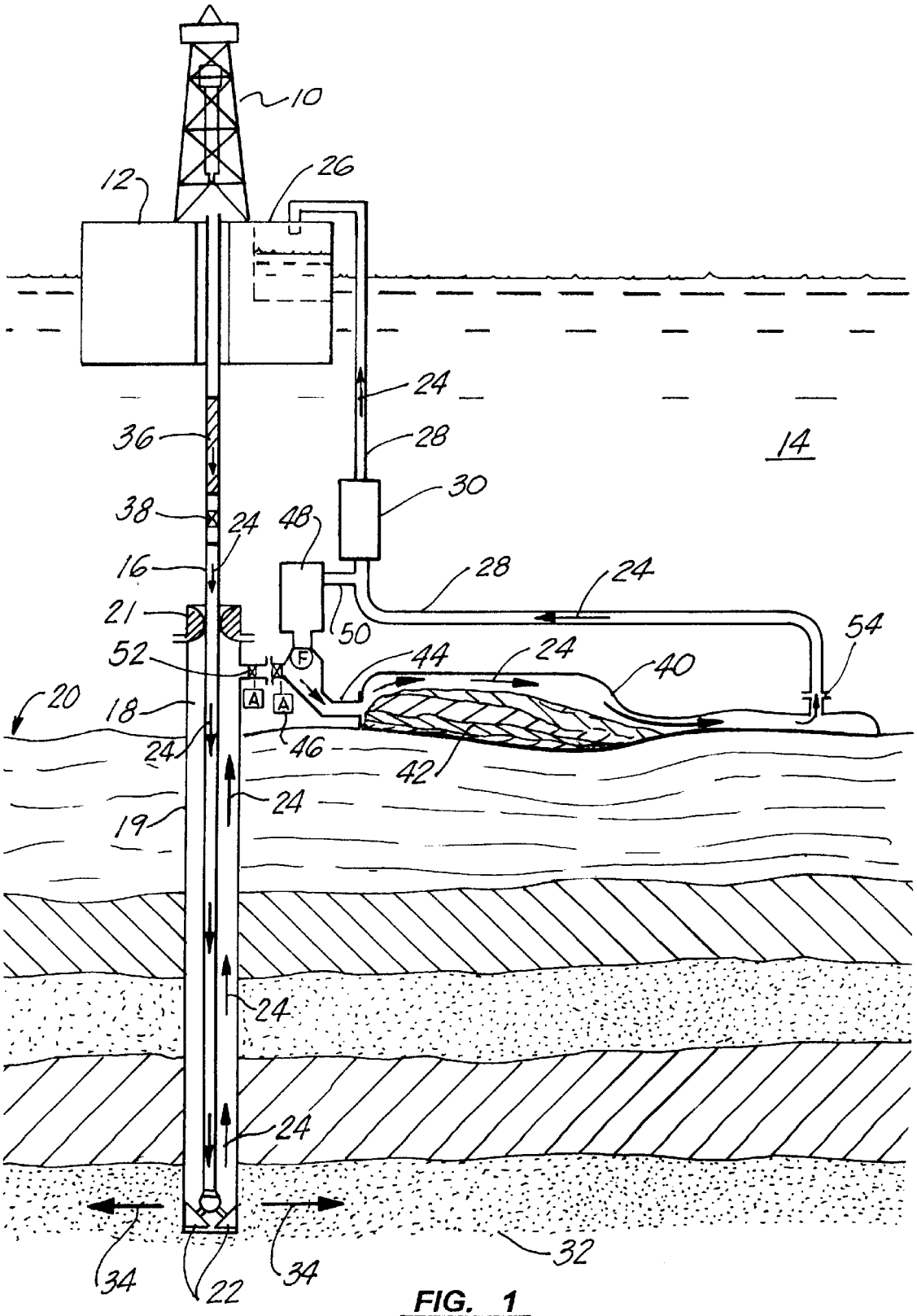
FIG. 1 is a schematic diagram of an underwater well in which an expandable tank is used in accordance with the invention.

Although the invention has special applicability in connection with deep water wells, which are wells in water from 2,500–10,000 feet deep and deeper, it can be used in conjunction with other types of wells. Referring to FIG. 1, a drilling rig 10 is located on a platform 12 floating on the surface of a body of water 14. In a well-known manner, a string of drill pipe 16 extends from the rig 10 into an annulus 18 that is formed by a casing 19 and an open hole beneath the casing, in a formation beneath a subsea floor designated generally by reference numeral 20. Alternatively, as known in the art, the drill pipe 16 can extend through a string of marine riser pipe (not shown).

A known seal 21 or blowout preventor stack (not shown) of a known configuration surrounds the drill pipe 16. A rotary drill bit 22 is rotated by the drill string in a known manner for drilling a well in the formation 20.

As shown by arrows 24, drilling fluid, commonly known as drilling mud, is circulated downwardly through the drill pipe 16, through nozzles in the drill bit 22, and upwardly through the annulus 18. Typically, the drilling fluid is returned to a tank or reservoir 26 located on the platform 12 through a return conduit 28, which may be a part of a marine riser pipe (not shown), by means of a pump 30. The system just described for circulating the drilling fluid is well known and can include many variations, such as, for example, a vessel (not shown) in close proximity to the platform 12 for receiving the drilling fluid and the pump 30 being located either on the subsea floor or on the platform 12 instead of being connected in the return conduit 28. Other variations can also be used for the arrangement of parts and components.

One function of the drilling fluid is to remove particulate matter generated by the drill bit 22 from the well by circulating it to the reservoir 26, where the particulate material is removed so the drilling fluid can be recirculated. The drilling fluid must also maintain a positive pressure relative to various strata beneath the subsea floor. In general terms, pressure exerted by the drilling fluid in one layer of the strata which can be a shallow sand formation designated by reference numeral 32, as generally indicated by arrows 34. This pressure should be maintained at a level greater than the outward pressure exerted on fluids in the formation 32 caused by the weight of the sea water and overburden bearing on the strata, plus pressure being exerted outwardly by oil and gas in the formation. It is typical to maintain the pressure being exerted by the drilling fluid at about 500 psi over the outwardly-exerted pressure in the formation 32.

This outward pressure is maintained by a column of drilling fluid in the drill string 16 represented schematically by the cross-hatched portion 36 in the drill string 16. A valve 38 which is automatically actuated by a change in pressure on both sides of the valve can be provided in the drill string for holding the fluid column at a predetermined level and weight.

In addition, as the well is being drilled, the drill string must be pulled out of the hole when the drilling bit 22 are replaced. As the pipe is being pulled out of the hole, drilling fluid must be added in order to replace the volume in the annulus that was previously displaced by the drill pipe in order to prevent the drilling fluid from dropping below a pre-determined level.

If the positive pressure is not maintained, a blow out could occur if a pocket of oil and/or gas under pressure is contacted. A blowout could also occur if the pressure exerted by the drilling fluid becomes too great and exceeds the fracture pressure of the formation 32. When this happens, the drilling fluid will escape into the formation 32 and empty the annulus 18 of drilling fluid. If this occurs, and the drill bit 22 contacts a formation in which oil and/or gas is under pressure, there is nothing to hold that oil and/or gas back resulting in a blowout.

These problems are greatly exacerbated in deep water wells because the weight of the column of drilling fluid bearing on the formation 32 is much greater due to the length of the drill string. More importantly, in deep water wells, the distance through which the drilling fluid must be moved in order to return it to the surface is much greater than for shallow wells. This increases significantly the requirements for a pump such as the one designated by reference numeral 30 for pumping the drilling fluid containing the added weight of the particulate matter generated by the drill bit 22. The requirements of a pump 30 are so much greater than for shallow wells that it is difficult to pump the drilling fluid to the sea surface from such depths.

These problems have been solved by the invention described below. The invention includes positioning an expandable tank on the subsea floor that is connected between the annulus 18 and the return conduit 28 so that the drilling fluid flows through the tank as indicated by the arrow 24 in the expandable tank 40. The tank is shaped and dimensioned to allow at least a substantial amount of the cuttings and other particulate material to settle out of the drilling fluid as the fluid flows through the tank to the return conduit 28.

The tank 40 is preferably formed of a flexible material that can be rolled or folded so it can be transported in a rolled or folded condition from the water surface to the subsea floor and then unrolled or unfolded into position, as shown in FIG. 1. The tank can take any number of suitable shapes as long as it is allowed to expand as drilling fluid flows through it and particulate matter collects in the tank as it settles out of the drilling fluid. The tank 40 can be single or double walled. A double-walled tank 40, as shown in FIG. 2*a*, can provide protection against any leaks that may occur in the wall of the tank 40, by the addition of a known sealant in the space 40*a* formed between the walls.

Such an expandable tank automatically equalizes the hydrostatic pressure of water bearing on the outer surface of the tank and the pressure of the drilling fluid flowing through the tank, resulting in a balanced system. Thus, the tank is in effect a pressure compensated collector for particulate matter in the drilling fluid.

The settled-out particulate matter is shown generally in FIG. 1 and designated by reference numeral 42. In one preferred embodiment, the tank is formed at least in part of an elastomeric material such as neoprene, allowing the tank to expand as the particulate material 42 builds up in the tank 40. As is known in the art of fabricating such tanks, the neoprene or other elastomeric material can be reinforced by various known materials and methods. Other shapes and configurations known in the art for allowing the tank to expand as it fills up can also be used.

An inlet conduit 44 connects the tank 40 to the annulus 18. The inlet conduit 44 includes a control valve 46, which can be remotely actuated, for selectively allowing drilling fluid to flow into the tank or out of the tank through the inlet conduit 44. Under normal operating conditions, the fluid flows in the direction of the arrows 24 in order to circulate the fluid through the drill pipe and back to the reservoir 26. However, when the drill pipe is pulled, as discussed above, it is useful to reverse the flow of drilling mud in order to maintain sufficient pressure on the formation 32, in which case the valve 46 is reversed allowing flow to take place in the opposite direction from that shown by the arrows 24.

The inlet conduit 44 can also include a separating apparatus 48 of a known construction for separating gas from the drilling fluid flowing into the tank 40. When such an apparatus is used, the gas is introduced directly into the return conduit 28 through a gas conduit 50 so the gas does not flow into the tank 40.

A shutoff valve 52 can be provided in an outlet leading from the annulus, for stopping the flow of drilling fluid at any given time.

The tank 40 must be shaped so that the flow path for the drilling fluid in the tank is long enough to provide a sufficient resonance time to allow at least a substantial amount of the particulate material in the fluid to settle in the tank before the fluid flows into the return conduit 28. This can be done as shown in FIG. 1 where the fluid enters through the inlet conduit and then flows along the length of the tank 40 and then to an outlet 54 connected to the return conduit 28. Alternatively, a series of baffles, wiers or other types of flow diverting structures can be placed in the bag in order to optimize performance.

Figure 2:
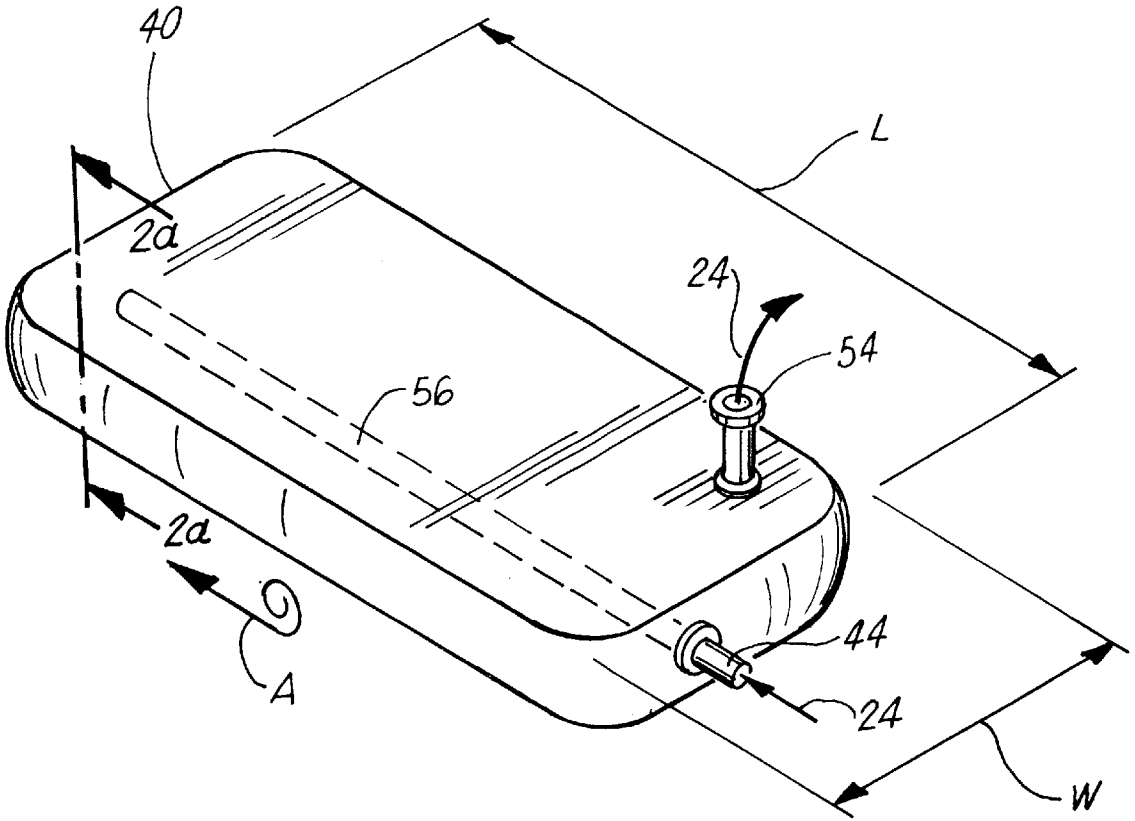
FIG. 2 is a perspective view of the tank shown in FIG. 1 showing an inlet hose in the tank connected to the inlet conduit and extending across a substantial distance in the tank.
Figure 2A:
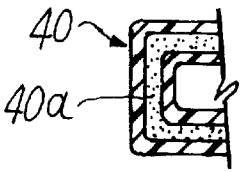
FIG. 2*a* is a partial sectional view of the tank in FIG. 2 showing a two-walled construction.

In another embodiment, as shown in FIG. 2, the tank 40 can be generally in the shape of a rectangular solid in which a hose 56 is connected to the inlet conduit and extends along the length L of the tank 40. As shown generally by the arrows 24, the drilling fluid flows from the inlet conduit through the hose 56 and then out of the tank 40 through the outlet 54, which is positioned on the same side of the tank but spaced along its width W as the inlet conduit 44. In this way, the fluid is directed to the opposite side of the tank from the inlet conduit 44 and then flows back along the distance of the hose to the outlet 54, which provides sufficient resonance time to allow a substantial amount of a particulate matter in the fluid to settle in the tank before the fluid flows into the return conduit 28.

Also, referring to FIG. 2, a schematically drawn arrow A is shown to represent the tank being initially rolled and then unrolled to the shape shown in FIG. 2 before it is connected to the inlet conduit 44 and the return conduit 28.

Figure 4:
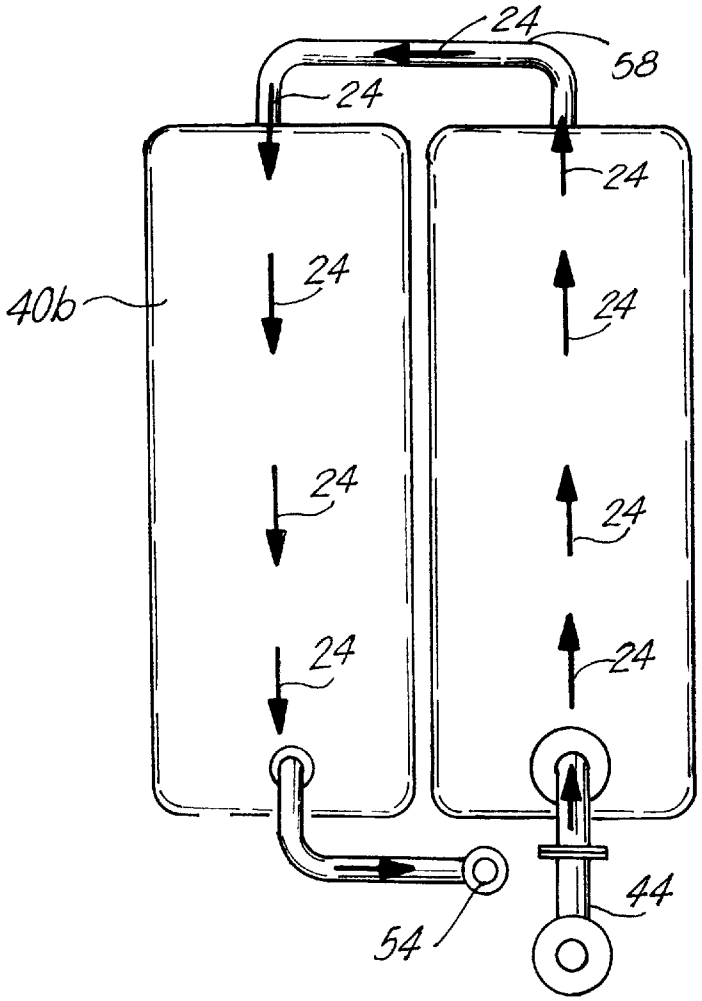
FIG. 4 is a schematic drawing showing two tanks connected in series.
Figure 3:
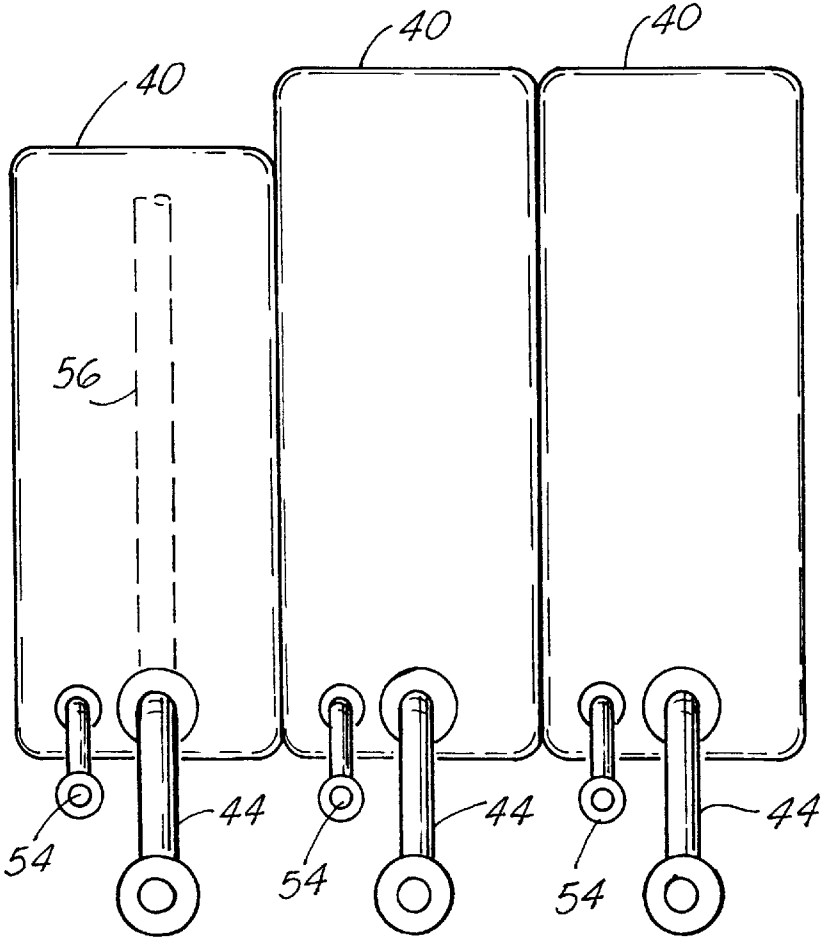
FIG. 3 is a schematic drawing showing a plurality of expandable tanks connected in parallel.

Other variations of the use of such a tank 40 are shown in FIGS. 3 and 4. In FIG. 3, a number of tanks 40 are placed side-by-side in parallel to inlet conduits 44 through which drilling mud from a plurality of annuluses (not shown) for a plurality of subsea wells (not shown) is received.

As shown in FIG. 4, two (or more) tanks 40 are connected in series through a connecting conduit 58. The fluid enters the tank 40 from the inlet conduit 44 and flows in the direction of the arrows 24, through the connecting conduit 58, and back through the tank **40*b*, to the return conduit 28 through the outlet 54**.

As discussed above, and shown in FIG. **2*a*, the tank 40 can be formed of two layers in order to create a double-walled tank 40 in which an annular space 40*a* exists between the inner and outer walls of the double-walled tank 40. In addition to providing protection against leaks, the double walled tank 40 provides a means for sealing the tank 40 after the completion of drilling. After drilling is completed and the mud has been pumped from the tank 40, the tank 40 contains only the particulate matter that has been removed from the drilling fluid. The double-walled tank 40 allows for the placement of cement or other types of known sealants in the annular space 40*a* between the inner and outer walls of the tank 40. This cement creates a dome around the inner wall of the tank 40 and seals the particulate matter within the tank 40** as it rests on the floor of the sea.

In addition to their use for subsea wells, an expandable tank such as the ones described above can also be used for separating particulate matter and liquids from drilling fluid for surface wells. In this embodiment, the tank 40 can be positioned on the ground or in a pit located close to the well. The use of such a tank 40 for surface wells could solve many environmental problems associated with preventing drilling fluid additives from escaping into the ground and air.

The tank 40 also has other uses in connection with production wells, both subsea and on land. For example, production from one or more wells can be stored in one or more of the tanks 40 that are positioned on the subsea floor or on land and connected to the well(s). Advantages of this use of the expandable tank 40 includes temporary storage for periodic removal of oil, a relatively inexpensive and transportable reservoir, and an environmentally safe means for storing oil.

Tanks of the type shown in the drawings and described above have many advantages. One is that with the shapes as shown, the tanks have a relatively small profile and therefore the influence of underwater currents is minimized. They hold a relatively large volume of particulate matter and can provide a long travel path for a sufficient resonance time to allow settlement of a substantial amount of particulate matter in the fluid. These tanks are also easy to handle, as they can be rolled or folded when they are transported to the subsea floor. The tank is then unrolled or unfolded and placed in the position shown in FIG. 1.

In addition, by removing a substantial amount of the particulate matter from the drilling fluid before it is returned to the water surface, a pump having significantly lower requirements for deep water wells can be used. In addition, it is easier to maintain the appropriate pressure on the formation 20 by providing a reservoir fluid which can be circulated back in the annulus when the drill string is pulled to change the drilling bit.

The foregoing disclosure and description of the invention are illustrative and explanatory thereof, and various changes in the details of the illustrated apparatus and construction and method of operation may be made without departing from the spirit of the invention.

What is claimed is:

1. A system for separating particulate material from drilling fluid for underwater wells of a type which comprise a drilling platform, a string of drill pipe extending from the platform to a subsea floor for drilling the well, an annulus extending into an earth formation beneath the subsea floor, the drill pipe running through the annulus into the formation for drilling a well in the formation, a means for circulating the drilling fluid downwardly through the string of drill pipe and upwardly through the annulus for removing particulate material generated from drilling the well, the system further including a return conduit and pump for returning the drilling fluid to a water surface, the system comprising:

a. an expandable tank positioned on the subsea floor and connected between the annulus and the return conduit so that the drilling fluid flows through the tank;

b. the tank being shaped and dimensioned to allow at least a substantial amount of particulate material to settle out of the drilling fluid a as the fluid flows through the tank to the return conduit.

2. The system of claim 1, wherein the expandable tank is formed at least in part of a flexible material that can be rolled or folded while being transported.

3. The system of claim 1, wherein the tank is formed at least in part of an elastomeric material.

4. The system of claim 3, wherein said elastomeric material includes a reinforced neoprene.

5. The system of claim 1, and further including an inlet conduit between the annulus and the tank, the inlet conduit including a control valve for selectively allowing drilling fluid to flow into the tank or out of the tank through the inlet conduit.

6. The system of claim 5, and further including a remotely actuated control valve.

7. The system of claim 5, and further including a gas conduit connected between the inlet conduit and the return conduit, and an apparatus between the inlet conduit and gas conduit for separating the gas from the drilling fluid before it enters the tank.

8. The system of claim 1, where the pump for circulating the drilling fluid is connected to the return conduit.

9. The system of claim 1, wherein a flow path for the fluid in the tank is dimensioned to provide a sufficient resonance time to allow at least a substantial amount of the particulate material in the fluid to settle in the tank before the fluid flows into the return conduit.

10. The system of claim 1, and further including an inlet hose in the tank connected to an inlet conduit and extending across a substantial distance in the tank, and an outlet connected to the return conduit in the vicinity of the connection between the inlet hose and the inlet conduit for allowing the fluid to travel a substantial distance in the tank before flowing into the return conduit.

11. The system of claim 1, and further including a plurality of expandable tanks connected in parallel to conduits receiving drilling mud from annuluses for a plurality of subsea wells.

12. The system of claim 1, and further including a plurality of expandable tanks connected in series.

13. The system of claim 1, wherein the tank is formed with at least one wall.

14. The system of claim 13, wherein the tank is formed of at least two walls including an annulus between at least two walls in which a sealant for sealing said two walls has been placed.

15. A method of separating particulate material from drilling fluid while drilling an underwater well, comprising the steps of:

a. connecting an expandable tank located on a subsea floor between an annulus of an underwater well and a return conduit for the drilling fluid, the tank being shaped and dimensioned to allow at least a substantial amount of a particulate material to settle out of the drilling fluid as the fluid flows through the tank;

b. circulating drilling fluid downwardly through drill pipe extending through the annulus and upwardly through the annulus as the well is being drilled;

c. separating particulate material from the drilling fluid by flowing drilling fluid through the tank.

16. The method of claim 15, and further including the step of positioning the tank on the subsea floor by lowering the tank from a surface in a rolled condition and unrolling the tank after it is on the subsea floor.

17. The method of claim 15, and further including the step of positioning the tank on the subsea floor by lowering the tank from a surface in a folded condition and unfolding the tank after it is on the subsea floor.

18. The method of claim 15, and further including the step of providing a control valve between the annulus and an inlet conduit connected to the tank, the control valve selectively allowing the drilling fluid to flow into or out of the tank through the inlet conduit.

19. The method of claim 15, and further including the step of separating gas from the drilling fluid and directing the gas into the return conduit before the drilling fluid flows into the tank.

20. The method of claim 19, and further including the step of separating the gas by providing an apparatus in an inlet conduit.

21. The method of claim 15, wherein the step of circulating said drilling fluid includes actuating a pump connected to the return conduit.

22. The method of claim 15, wherein the step of separating particulate material from the drilling fluid includes connecting said tank that is dimensioned to provide a sufficient resonance time to allow at least a substantial amount of the particulate material in the fluid to settle in the tank before the fluid flows into the return conduit.

23. The method of claim 15, wherein the step of separating particulate material from the drilling fluid includes providing an inlet hose in the tank connected to an inlet conduit and extending across a substantial distance in the tank, and an outlet connected to the return conduit in the vicinity of the connection between the inlet hose and the inlet conduit for allowing the fluid to travel a substantial distance in the tank before flowing into the return conduit.

24. The method of claim 15, and further including the step of providing a plurality of expandable tanks connected in parallel to conduits receiving drilling fluid from annuluses for a plurality of subsea wells.

25. The method of claim 15, and further including the step of providing a plurality of expandable tanks connected in series.

26. The method of claim 15, and further including the step of providing a tank formed of at least one wall.

27. The method of claim 26, wherein the tank is formed of at least two walls including an annulus between the at least two walls in which a sealant for sealing the tank has been placed.

28. A tank for being positioned on a surface and separating particulate material from drilling fluid for an underwater well, comprising:

a. an expandable tank that is shaped and dimensioned to allow at least a substantial amount of particulate material to settle out of drilling fluid as it flows through the tank;

b. an inlet in the tank through which drilling fluid from an underwater well can flow into the tank;

c. an outlet in the tank through which drilling fluid from which a substantial amount of particulate material has been separated can flow out of the tank;

d. an inlet conduit and a control valve in the inlet conduit for selectively allowing drilling fluid to flow into the tank or out of the tank through the inlet conduit.

29. The tank of claim 28, wherein the tank is formed of a flexible material than can be rolled or folded while being transported.

30. The tank of claim 28, wherein the tank is formed at least in part of an elastomeric material.

31. The tank of claim 30, wherein the elastomeric material includes a reinforced neoprene.

32. The tank of claim 28, wherein the control valve is remotely actuated.

33. The tank of claim 28, wherein an inlet conduit includes an apparatus for separating gas from the drilling fluid before the drilling fluid flows into the tank.

34. The tank of claim 28, wherein the tank is dimensioned to provide a sufficient resonance time to allow at least a substantial amount of the particulate material in the fluid to settle in the tank before the fluid flows into a return conduit.

35. The tank of claim 28, and further including an inlet hose in the tank connected to the inlet and extending across a substantial distance in the tank, the outlet being located in the vicinity of the inlet for allowing the fluid to travel a substantial distance in the tank before flowing through the outlet.

36. The tank of claim 28, wherein the tank is formed of at least one wall.

37. The tank of claim 36, wherein the tank is formed of at least two walls including an annulus between the at least two walls in which a sealant for sealing the walls has been placed.

* * * * *